US005927492A

United States Patent [19]

Moore

[11] Patent Number: 5,927,492

[45] Date of Patent: Jul. 27, 1999

[54] DECORATIVE CONTAINER FOR STORING PLUMBING PLUNGER

[76] Inventor: Gregory K. Moore, 6102 N. 8th St., Philadelphia, Pa. 19120

[21] Appl. No.: 08/740,844

[22] Filed: Nov. 4, 1996

[51] Int. Cl.[6] ..... A47B 81/02; A47K 17/00

[52] U.S. Cl. ..... 206/349; D6/524; 4/255.11; 220/367.1; 220/636; 220/796

[58] Field of Search ..... 206/349, 209, 206/362.2, 457; 4/255.11; 220/8, 796; 312/206; D32/14

[56] References Cited

U.S. PATENT DOCUMENTS

| | | | |
|---|---|---|---|
| D. 292,631 | 11/1987 | Tash . | |
| D. 344,681 | 3/1994 | Callicutt | D6/524 |
| D. 383,935 | 9/1997 | Zawalsky | D6/524 |
| 2,212,340 | 8/1940 | Davis | 220/367.1 |
| 2,606,708 | 8/1952 | Irvan | 220/796 |
| 4,192,561 | 3/1980 | Gunn . | |
| 4,432,451 | 2/1984 | Hooser . | |
| 4,458,368 | 7/1984 | Webb . | |
| 5,040,679 | 8/1991 | Rehmann . | |
| 5,335,374 | 8/1994 | Wilk et al. . | |
| 5,353,442 | 10/1994 | Rotter . | |
| 5,456,356 | 10/1995 | Kurzawa | 206/349 |

*Primary Examiner*—Jim Foster
*Attorney, Agent, or Firm*—Panitch Schwarze Jacobs & Nadu, P.C.

[57] ABSTRACT

A decorative cover is adapted for receiving and storing a plumbing plunger in a generally upright position. The decorative container includes a base member for receiving the plumbing plunger and a cover member for engaging the base member and covering the plumbing plunger. The base member has a generally flat bottom wall and four generally inwardly tapered intersecting sidewalls extending upwardly from an upper surface of the bottom wall by a predetermined distance. A portion of the bottom wall extends outwardly beyond the sidewalls to establish a supporting lip. The cover member has four intersecting sidewalls which taper inwardly from a lower end to a curved upper portion. The cover member is sized and shaped to surround and snugly engage the sidewalls of the base member when the cover member is installed on the base member. The lower end of the cover member engages and is supported by the base member supporting lip.

6 Claims, 4 Drawing Sheets

DECORATIVE CONTAINER FOR STORING PLUMBING PLUNGER

BACKGROUND OF THE INVENTION

The present invention relates generally to a container for storing elongated objects and, more particularly, to a decorative container for storing any one of a number of different sized and shaped plumbing plungers.

The use of plumbing plungers for taking care of clogs in the bathroom, kitchen and other locations throughout the home as well as within commercial and industrial settings is well known. In many households, business and industrial settings, such plumbing plungers are typically maintained in the bathroom, generally beside or behind a bathroom fixture, such as the toilet or sink. Storing a plumbing plunger in this manner is not only unsightly but is also unsanitary. In addition, such plumbing plungers become an attraction to children or pets who may be subjected to contact with infectious bacteria which may remain on a portion of the plunger after use.

The present invention overcomes many of the problems associated with the storage of a plumbing plunger by providing a convenient closable decorative container. The container in accordance with the present invention is adapted for the storage in an upright position of virtually any type or size of plumbing plunger in general use in virtually any location. The container in accordance with the present invention is neat, attractive and maintains a plumbing plunger safely out of the sight and reach of children and pets and yet easily accessible when needed. The container in accordance with the present invention maintains a plunger stored therein in a sanitary condition, while providing a neat and pleasant outward appearance.

SUMMARY OF THE INVENTION

Briefly stated, the present invention comprises a decorative container for receiving and storing a plumbing plunger in a generally upright position. The decorative container includes a base member and a cover member adapted to be secured to the base member. The base member has a generally flat bottom wall and four generally upwardly tapered intersecting sidewalls extending upwardly from an upper side of the bottom wall by a predetermined distance. A portion of the bottom wall extends outwardly beyond the sidewalls to establish a supporting lip. The cover member has four intersecting sidewalls which taper inwardly from a lower end to a curved upper portion. The cover member is sized and shaped to surround and snugly engage the sidewalls of the base member when the cover member is installed on the base member. In addition, when the cover member is installed on the base member, the cover member lower end engages and is supported by the base member supporting lip.

BRIEF DESCRIPTION OF THE SEVERAL VIEWS OF THE DRAWINGS

The foregoing summary, as well as the following detailed description of a preferred embodiment of the present invention, will be better understood when read in conjunction with the appended drawings. Although, in the drawings, a preferred embodiment is shown, it will be appreciated by those of ordinary skill in the art that the present invention is not limited to the arrangements and instrumentalities as shown. In the drawings.

DETAILED DESCRIPTION OF THE INVENTION

Figure 1:
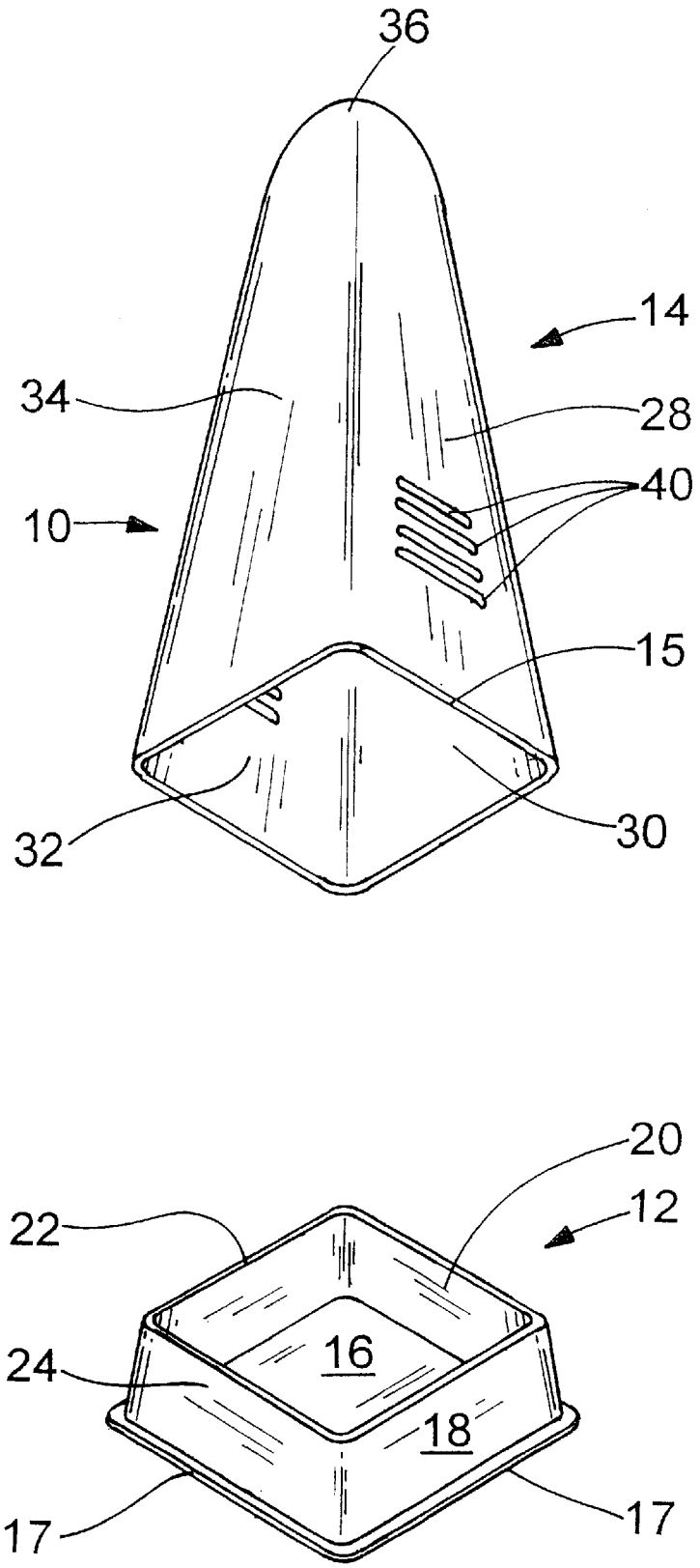
FIG. 1 is an exploded perspective view of a container for storing a plumbing plunger in accordance with a preferred embodiment of the present invention.

Referring to the drawings, wherein the same reference numerals are used to indicate like same components throughout the several figures, there is shown in FIG. 1 an exploded perspective view of a decorative container 10 for storing a plumbing plunger in accordance with a preferred embodiment of the present invention. The container 10 is comprised of a base member 12 and a cover member 14. In the present embodiment, both the base member 12 and the cover member 14 are molded of a plastic material which is preferably of a type well known to those of ordinary skill in the art. Preferably, both the base member 12 and the cover member 14 are made of the same plastic material.

Figure 3:
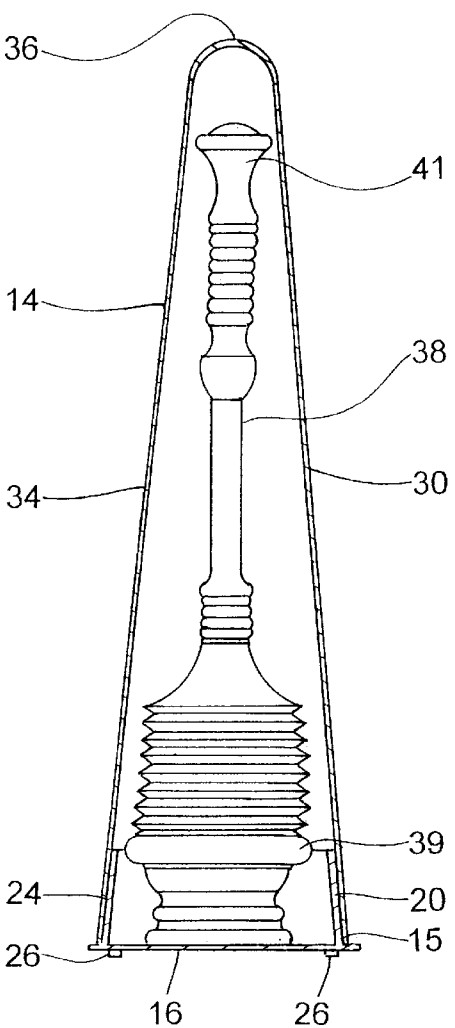
FIG. 3 is a sectional view of the container of FIG. 1.
Figure 2:
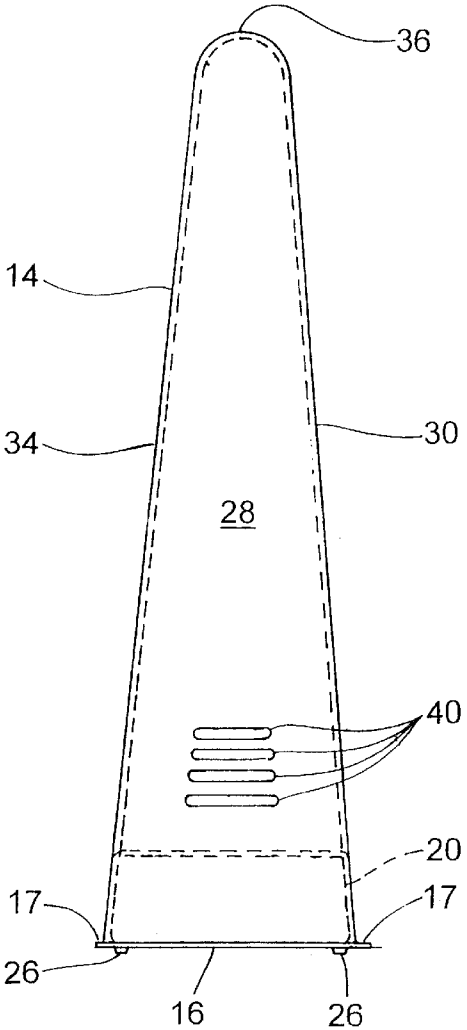
FIG. 2 is a right side elevational view of the container of FIG. 1.
Figure 4:
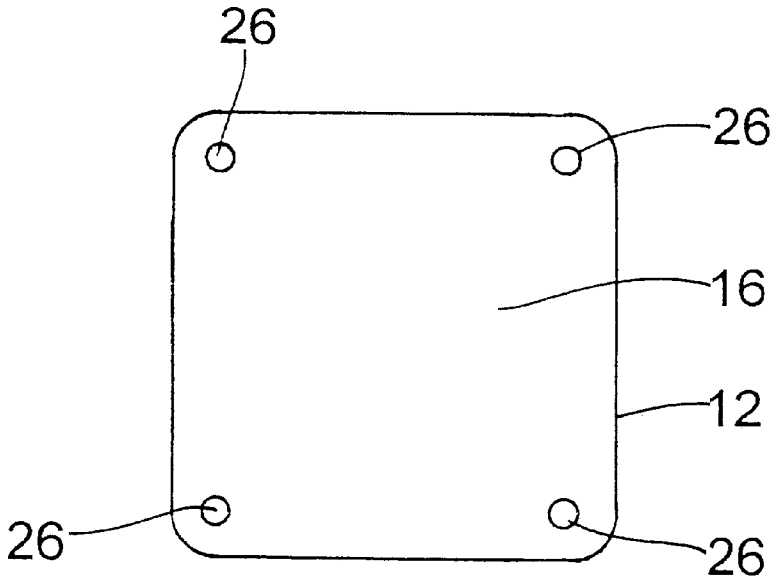
FIG. 4 is a bottom plan view of the container of FIG. 1.
Figure 7:
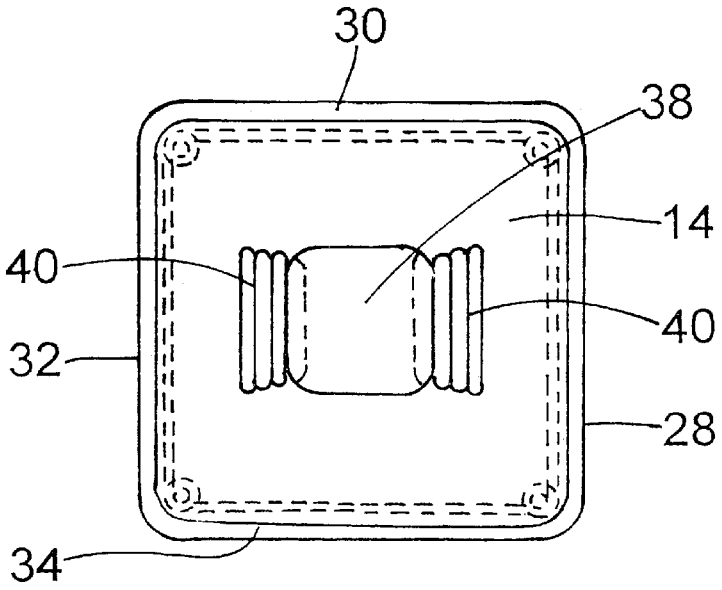
FIG. 7 is a view similar to FIG. 5 showing additional details of the container in phantom.
Figure 6:
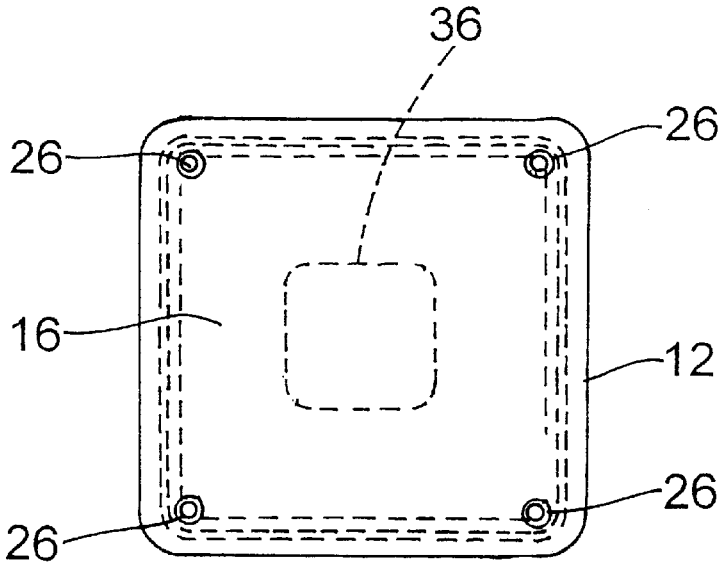
FIG. 6 is a view similar to FIG. 4 showing details of the container in phantom.

Referring to FIGS. 1, 2 and 4, the base member 12 is generally square in plan view with smoothly rounded corners and is comprised of a generally flat bottom wall 16 and four intersecting or adjoining sidewalls 18, 20, 22 and 24. As best shown in FIGS. 1 and 2, the sidewalls 18, 20, 22, 24 extend generally upwardly from the upper side of the bottom wall 16 by a predetermined distance with a slight inward taper. In addition, the corners at which the sidewall 18, 20, 22, 24 intersect each other are generally smoothly rounded as best shown in FIG. 1 to provide a pleasing appearance. A portion of the bottom wall 16 extends outwardly beyond each of the sidewalls 18, 20, 22, 24 to establish a generally continuous supporting lip 17 which extends all of the way around the base member 12 for purposes which will hereinafter become apparent. In this manner, the base member 12 is generally tray-like in configuration. Preferably, the base member 12 is sized so that it can conveniently receive and retain within the area defined by the sidewalls 18, 20, 22, 24 virtually any standard size plunger 38 (see FIG. 3) such that at least a substantial portion of the functioning portion 39 of the plunger 38 is contained within the sidewalls 18, 20, 22, 24 which serve as retainer walls. In this manner, any excess liquid, solid or other material which may remain on the plunger 38 is captured and maintained within the base member 12 once the plunger 38 is installed therein as shown in FIG. 3.

As best shown in FIGS. 2 and 4, the underside of the bottom wall 16 of the base member 12 includes four spaced apart feet 26. The feet 26 function to raise the base member 12 a predetermined distance above the surface of the floor or other supporting surface. Preferably, the feet 26 are in the form of suction cups so that once the base member 12 is positioned on a floor or other supporting surface, the feet 26 also function to secure or hold the base member 12 in place. Preferably, the suction cups are made of a rubber material and are positioned on the bottom wall 16 so as to be generally aligned with the four corners established by the intersection of the four sidewalls 18, 20, 22, 24.

The cover member 14 is generally in the shape of a four-sided pyramid and includes four intersecting sidewalls 28, 30, 32 and 34 which taper inwardly to a generally smoothly curved upper portion 36. As with the base member 12, the corners where the sidewalls 28, 30, 32, 34 intersect or adjoin with each other, are generally smoothly curved as best shown in FIG. 1. The lower end 15 of the cover member 14 is generally square in cross section and is sized to have an inside dimension which is slightly greater than the outside dimension of the sidewalls 18, 20, 22, 24 of the base member 12 at their junction with the bottom wall 16. Preferably, the sidewalls 28, 30, 32 and 34 of the cover member 14 taper inwardly in substantially the same manner and extent as the inward taper of the sidewalls 18, 20, 22, 24 of the base member 12 so that when the cover member 14 is installed on the base member 12 as shown in FIG. 2, the sidewalls 18, 20, 22, 24 of the base member 12 and surrounded by and engage the corresponding lower portion of the sidewalls 28, 30, 32, 34 of the cover member 14 with a snug overlapping fit. As best shown in FIGS. 2 and 3, the distal ends of the sidewalls 28, 30, 32, 34 which form the lower end 15 of the cover member 14 engage and are supported by the supporting lip 17 of the bottom wall 16 of the base member 12 which extends slightly beyond the sidewalls 18, 20, 22, 24 as hereinbefore described.

Preferably, the length or height of the cover member 14 is at least slightly greater than the overall length of a standard plumbing plunger 38 and more preferably is at least slightly greater than the overall length of the longest standard plumbing plunger. Preferably, the taper of the sidewalls 28, 30, 32, 34 of the cover member 14 is such that the interior dimension proximate the upper portion 36 of the cover member 14 is large enough to receive the distal end of the handle 41 of any standard plumbing plunger 38 when held in an upright position as shown in FIG. 3.

Figure 5:
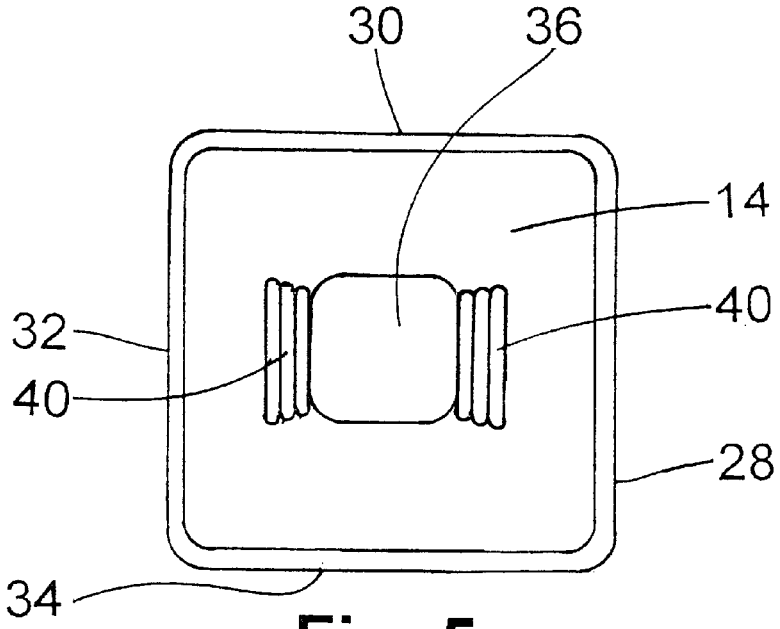
FIG. 5 is a top plan view of the container of FIG. 1.

As best shown in FIGS. 1, 2 and 5, a plurality of elongated openings or slots 40 extend through two of the sidewalls 28, 32 of the cover member 14. Preferably, the slots 40 are generally laterally centered within the sidewalls 20, 32 and are located slightly above the upper edge of the sidewalls 18, 20, 22, 24 of the base member 12. Preferably, there are four slots 40 of varying lateral length with the lowermost slot having the longest lateral length and the uppermost slot having the shortest lateral length to be consistent with the smoothly tapered appearance of the cover member 14. The slots 40 serve to provide ventilation to the interior of the container 10 to facilitate the removal of odor, to permit the escape of any moisture held within the base member 12 and to otherwise maintain a plumbing plunger 38 contained within the container 10 in a serviceable condition.

In using the container 10, the base member 12 is preferably placed at a desired location on a floor or other supporting surface for storing a plumbing plunger 38. The base member 12 is then pushed downwardly toward the floor or other supporting surface so that the suction cup feet 26 are actuated to engage and hold the base member 12 at the desired position on the floor or other supporting surface. It may be desirable to place a small amount of water on the undersurface of each of the suction cup feet 26 to improve gripping force. A plumbing plunger 38 may then be placed on the base member 12 in the area between the sidewalls 18, 20, 22, 24 in an upright position with the handle 41 of the plumbing plunger 38 extending upwardly as shown in FIG. 3. As previously noted, any liquid or solid materials left on the operating portion 39 of the plumbing plunger 38 are captured and retained within the base member 12. In this manner, the floor or other supporting surface is kept clean and sanitary.

Once the plumbing plunger 38 is installed within the base member 12 in an upright position as shown in FIG. 3, the cover member 14 is installed over the base member 12 as shown in FIGS. 2 and 3. Since the interior dimension of the cover member 14 is at least slightly greater than the dimensions of the plumbing plunger 38, the installation of the cover member 14 does not effect the upright position of the plumbing plunger 38. The lower end 15 of the cover member 14 engages and is supported by the base member lip 17. As previously noted, the sidewalls 28, 30, 32, 34 of the cover member 14 tightly engage the corresponding sidewalls 18, 20, 22, 24 of the base member 12 with a snug fit to thereby effectively secure the cover member 14 to the base member 12. In this manner, it is difficult for small children or pets to remove the cover member 14 from the base member 12 and thereby obtain access to the plumbing plunger 38. As previously stated, the slots 40 extending through the cover member 14 on opposite sidewalls 28, 32 provide cross ventilation to facilitate the removal of any moisture, odors or the like from the interior of the container 10 while the plumbing plunger 38 is being stored.

When it becomes necessary to use the plumbing plunger 38, the cover member 14 is removed by pulling the cover member 14 straight upwardly. Because of the suction cup feet 26, the base member 12 remains secured to the floor or other supporting surface. By pulling the cover member 14 straight upwardly with respect to the base member 12, the plumbing plunger 38 remains in its upright position as shown in FIG. 3 and is exposed and ready for use. The plumbing plunger 38 may then be removed from the base member 12 for use in breaking up a clog or the like. Thereafter, the plumbing plunger 38 may be returned to the base member 12 and the cover member 14 may be reinstalled on the base member 12 as described above.

From the foregoing description of a preferred embodiment, it can be seen that the present invention comprises a container for storing plumbing plungers. The container is adapted for receiving virtually any size plumbing plunger and for maintaining the plumbing plunger stored therein in a clean, safe, upright condition. It will be appreciated by those skilled in the art that changes could be made to the embodiments described above without departing from the broad inventive concept thereof. It is understood, therefore, that this invention is not limited to the particular embodiment disclosed, but it is intended to cover modifications within the spirit and scope of the present invention as defined by the appended claims.

I claim that the parts stated here are all of my own concept and they are original as stated in the detail in this patent:

1. A decorative container for receiving and storing a plumbing plunger in a generally upright position comprising:

a base member having a generally flat bottom wall and four generally inwardly tapered intersecting sidewalls extending upwardly from an upper side of the bottom wall by a predetermined distance, a portion of the bottom wall extending outwardly beyond the sidewalls to establish a supporting lip; and a cover member having four intersecting sidewalls which taper inwardly from a lower end to a curved upper portion, the cover member being sized and shaped to surround and snugly engage the sidewalls of the base member when the cover member is installed on the base member with the cover member lower end engaging and being supported by the base member supporting lip.

2. The decorative container as recited in claim 1 wherein the base member includes four spaced apart supporting feet on an underside of the bottom wall opposite the upper side from which the sidewalls extend.

3. The decorative container as recited in claim 2 wherein the feet comprise suction cups.

4. The decorative container as recited in claim 1 wherein the cover member further includes a plurality of slots extending therethrough.

5. The decorative container as recited in claim 4 wherein a first group of slots extend through a first sidewall of the cover member and a second group of slots extend through a second sidewall of the cover member wherein the first and second sidewalls oppose each other.

6. The decorative container as recited in claim 3 wherein the cover member is of a length and the curved upper portion of the cover member is sized and shaped to receive a handle of a plumbing plunger.

* * * * *